US005727581A

United States Patent [19]

Tekriwal et al.

[11] Patent Number: 5,727,581

[45] Date of Patent: Mar. 17, 1998

[54] DISHWASHER SPRAY-ARM ASSEMBLY

[75] Inventors: Prabhat Kumar Tekriwal, Schenectady, N.Y.; Andrew Joseph Spanyer, Louisville; Joseph Duane Tobbe, Taylorsville, both of Ky.; Dennis Lee Heinz, Floyd Knobs, Ind.

[73] Assignee: General Electric Company, Schenectady, N.Y.

[21] Appl. No.: 720,649

[22] Filed: Oct. 2, 1996

[51] Int. Cl.[6] ..... B08B 3/02

[52] U.S. Cl. ..... 134/104.4; 134/176; 134/179; 239/251; 239/261

[58] Field of Search ..... 134/104.1, 104.4, 134/109, 111, 176, 179, 560, 570, 580, 198; 239/251, 261

[56] References Cited

U.S. PATENT DOCUMENTS

| | | | |
|---|---|---|---|
| 4,991 | 2/1847 | Jarvis et al. | 134/179 |
| 3,077,200 | 2/1963 | Guth | 134/176 |
| 3,288,156 | 11/1966 | Jordan et al. | 134/176 |
| 3,385,523 | 5/1968 | Stouder | 239/261 |
| 3,776,465 | 12/1973 | Baker | 239/261 |
| 3,866,837 | 2/1975 | Jenkins | 239/261 |
| 4,172,563 | 10/1979 | Wooley et al. | 134/176 |
| 4,174,723 | 11/1979 | Long | 239/261 |
| 4,509,687 | 4/1985 | Cushing | 134/179 |
| 5,235,994 | 8/1993 | Comin et al. | 134/176 |
| 5,241,975 | 9/1993 | Yanagihara | 134/179 |
| 5,330,102 | 7/1994 | Jarvis et al. | 239/151 |
| 5,433,228 | 7/1995 | Dingler | 134/104.1 |

FOREIGN PATENT DOCUMENTS

| | | | |
|---|---|---|---|
| 3442779 | 6/1986 | Germany . | |
| 1354514 | 5/1974 | United Kingdom | 134/179 |
| 1462398 | 1/1977 | United Kingdom . | |

*Primary Examiner*—Frankie L. Stinson

*Attorney, Agent, or Firm*—Patrick K. Patnode; Donald S. Ingraham

[57] ABSTRACT

A spray-arm assembly comprises a convergent base section having a bell mouth, a throat section, and a cylindrical housing that extends axially along the periphery of the throat section, a lower cylindrical conduit section and an upper cylindrical conduit section, and a divergent diffuser section having an entry area and an exit area. In one embodiment of the instant invention, a drainage groove is disposed within the diffuser section in order to facilitate the drainage of excess water from the spray-arm assembly once a washing or rinsing phase of operation is completed. In another embodiment of the instant invention, at least one drainage notch is formed at the mouth of the divergent diffuser section in order to create a drainage passage between the divergent section and the convergent base section. In another embodiment of the instant invention, a plurality of ribs are disposed on an inner bottom surface of the convergent base section so as to provide a temporary collection location for food particles that flow to this location during drainage. Food particles disposed in these ribs can be readily purged from the area during a flush-out mode of operation.

14 Claims, 3 Drawing Sheets

DISHWASHER SPRAY-ARM ASSEMBLY

BACKGROUND OF THE INVENTION

This application relates to dishwashers, and in particular relates to a dishwasher spray-arm assembly.

Most, if not all, dishwashers have a number of washing and rinsing phases and a final drying phase. During a typical washing or rinsing phase, a pump forces washing or rinsing liquid upwardly through a conduit and into a spray-arm section. The washing liquid is distributed from the spray-arm by means of orifices spaced therealong. The spray-arm is reactively driven by having at least one of the orifices disposed to discharge a jet stream in a direction such that the spray-arm reacts to the force of the discharge and rotates in a horizontal plane.

During a typical washing or rinsing phase approximately 28–30 gallons of water per minute is pumped through the conduit assembly to the spray-arm section. A relatively large amount of this flow (between 4–6 gallons) leaks through the seal between the stationary and moving portions of the conduit assembly. This large amount of water leakage is detrimental to the performance and reliability of the dishwasher assembly and requires increased energy usage. As the water leaks through the conduit assembly, food particles, carried by the water flow, get lodged between the stationary and moving surfaces causing a reduced spray-arm speed that in turn reduces the overall washing performance of the dishwasher and possibly causes deterioration of the assembly.

Upon completion of the washing or rinsing phase, the spray-arm stops and the drying phase begins. In conventional spray-arm assemblies, excess water becomes trapped in the wing section of the spray-arm assembly and remains in the spray-arm even after drainage.

Additionally, it is desirable to minimize the part count within the dishwasher assembly, thereby reducing dishwasher manufacturing time and ultimately reducing overall product cost.

Therefore, it is apparent from the above that there exists a need in the art for a spray-arm assembly that lowers water leakage during washing or rinsing phases, allows drainage to any excess water trapped in the wing section of the spray-arm assembly, and requires fewer parts, thereby increasing reliability and reducing overall product cost.

SUMMARY OF THE INVENTION

In accordance with this invention, a dishwasher spray-arm assembly comprises a convergent base section having a bell mouth, a throat section, and a cylindrical housing that extends axially along the periphery of the throat section, a lower cylindrical conduit section and an upper cylindrical conduit section, and a divergent diffuser section having an entry area and an exit area. The spray-arm assembly further comprises a rotatable spray-arm section having an open hub area and at least two hollow wing sections radially extending from the open hub area. The divergent diffuser section is integrally attached with the spray-arm and is positioned such that the entry area of the diffuser section is aligned with the throat section of the convergent base section. The spray-arm is integrally attached with the divergent diffuser section such that the open hub area is aligned with the exit area of the diffuser section so as to define a conical chamber area. The spray-arm assembly further comprises a collapsible water tower adapted to be nestably positioned within the conical chamber area. In one embodiment of the instant invention, a drainage groove is formed within the diffuser section in order to facilitate the drainage of excess water from the spray-arm assembly once the washing or rinsing phase of operation is completed. In another embodiment of the instant invention, at least one drainage notch is formed at the mouth of the divergent diffuser section in order to create a drainage passage between the divergent section and the convergent base section. In another embodiment of the instant invention, a plurality of ribs are disposed on an inner bottom surface of the convergent base section so as to provide a temporary storage area for food particles that flow to this location during drainage. Food particles disposed in these ribs can be readily purged from the area during a flush-out mode of operation.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
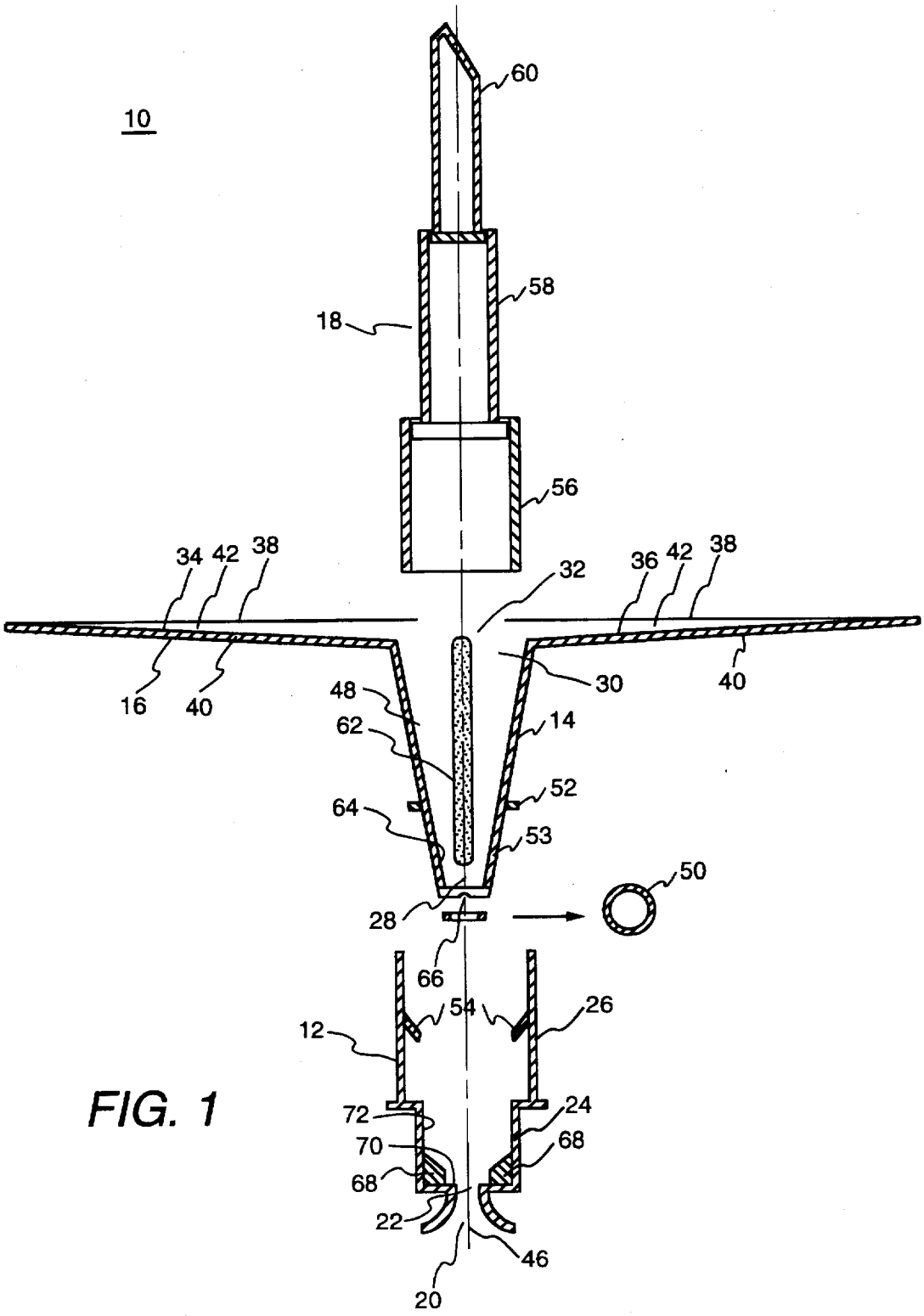
FIG. 1 is a cross-sectional elevational view of the spray arm assembly in accordance with this invention.
Figure 2:
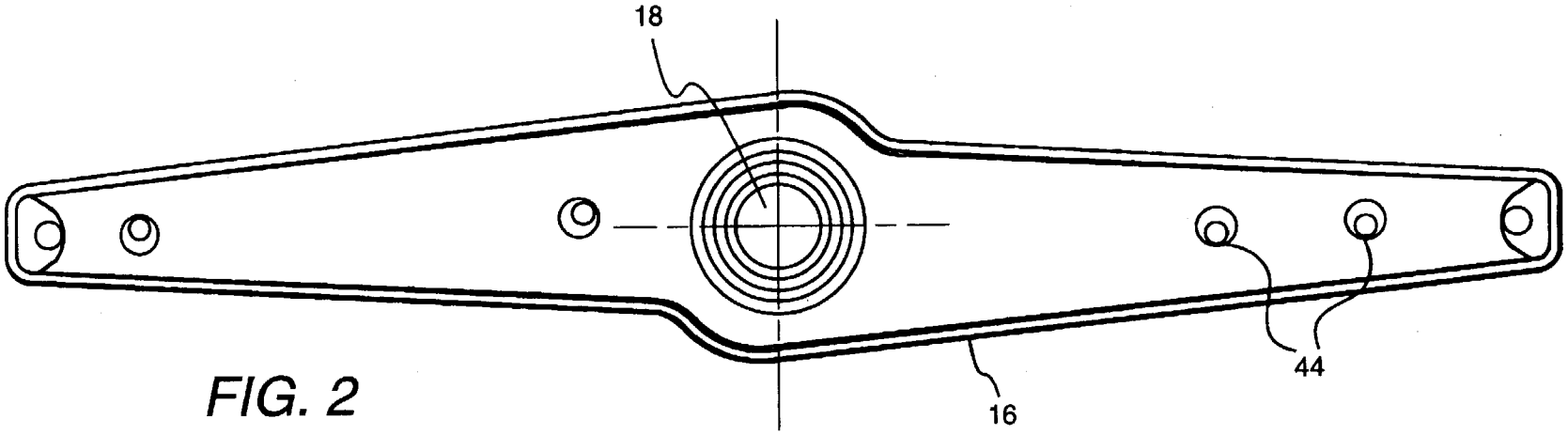
FIG. 2 is a plan view of the spray arm wing section in accordance with this invention.

A spray-arm assembly 10 comprises a convergent base section 12, a divergent diffuser section 14, a rotatable spray-arm 16, and a collapsible water tower 18, as illustrated in FIGS. 1 and 2.

Convergent base section 12 comprises a bell mouth 20, which bell mouth 20 is adapted to be removably attached to a pump (not shown), a throat 22, a lower cylindrical conduit section 24 extending axially along the periphery of throat 22 and an upper conduit section 26, having a radius greater than lower section 24, extending axially along the periphery of lower cylindrical conduit section 24 so as to form one continuous convergent base section 12. Convergent base section 12 typically comprises Glass-filled Polypropylene. In one embodiment, bell mouth 20 is approximately 1.86 inches wide, converges at a nominal height of 0.63 inches to a diameter of approximately 0.65 inches at throat 22, widens once again at lower cylindrical conduit section 24 to a diameter of approximately 1.86 inches, and at a nominal height of 2.0 inches base section 12 further widens at upper cylindrical conduit section 26 to a diameter of approximately 2.3 inches. The diameter of upper cylindrical conduit section 26 remains 2.3 inches to a nominal height of 4.6 inches. The term "height" as used herein, refers to lengths measured from a reference point along the longitudinal axis of spray-arm assembly 10, typically, however not necessarily, the vertical axis.

Divergent diffuser section 14, generally conical in shape, comprises an entry area 28 and an exit area 30. Entry area 28 and exit area 30 are generally circular in shape, entry area 28 having a smaller diameter, typically in the range of about 0.7 to about 0.8 inches, than exit area 30, which typically has a diameter in the range of about 2.1 to about 2.2 inches. Divergent diffuser section 14 typically comprises a polymer such as 20% Talc-filled Polypropylene. In one embodiment, entry area 28 comprises a diameter of approximately 0.7 inches, exit area 30 comprises a diameter of approximately 2.15 inches and divergent diffuser section 14 has a nominal height of about 4.1 inches.

Rotatable spray-arm 16 comprises an open hub area 32, and at least a first wing section 34 and a second wing section 36, each of said wing sections comprising a respective top section 38 and a respective bottom section 40 defining a chamber area 42 therebetween. Washing liquid is distributed from spray-arm 16 by a plurality of directionalized orifices 44 (FIG. 2) formed within top section 38 of spray-arm 16. As used herein, the term directionalized orifice means an orifice disposed on said arm and oriented so as to cause fluid passing there through to be directed along a selected axis. Rotatable spray-arm 16 is reactively driven when washing liquid pumped through spray-arm 16 into respective chamber areas 42 of wing sections 34, 36 is discharged by directionalized orifices 44 in a direction such that spray-arm 16 reacts to the force of the discharge and rotates in a horizontal plane about a centerline spin axis 46. Spray-arm 16 is integral with divergent diffuser section 14 such that open hub area 32 is aligned with exit area 30 so as to define a conical inner chamber area 48. Divergent diffuser section 14 and spray-arm 16 typically comprise a polymer such as 20% Talc-filled Polypropylene.

When fully assembled, divergent diffuser section 14 is disposed within convergent base section 12 such that entry area 28 is positioned at, and aligned with, throat 22 of convergent base section 12. As used herein, the term "aligned with" refers to entry area 28 and throat 22 having a substantially similar diameter and shape so as to allow a smooth transition of flow from one section to the next. An annular bearing ring 50, typically a metallic washer, is positioned between divergent diffuser section 14 and convergent base section 12. Annular bearing ring 50 is adapted to facilitate rotation of divergent diffuser section 14. The phrase "adapted to facilitate rotation" as used above means generally that annular bearing ring 50 is flat and smooth so as to promote rotation between the stationary base and the rotating portion, while preventing wear between the parts.

Throat 22 is sized such that the system water pressure at the point of intimate contact between convergent base section 12 and divergent diffuser section 14, i.e. bearing 50 area, is approximately equal to atmospheric pressure. Accordingly, water leakage through this area is virtually eliminated. Due to the reduced cross-sectional area of throat 22, as compared to a conventional assembly, the water velocity increases at throat 22 and the water pressure in turn is reduced, in accordance with Bernoulli's principle.

An annular flange 52 is integrally disposed about an outer surface 53 of divergent diffuser section 14. During assembly, when divergent diffuser section 14 is positioned within convergent base section 12, annular flange 52 initially engages at least two downwardly sloping tabs 54. As used herein, the term "downwardly" refers to descending along an axis, typically the vertical axis, from a higher originating point to a lower terminating point. Tabs 54 are typically formed of the same material as convergent base section 12 and are rigidly attached at one end to upper cylindrical conduit section 26 and project radially inwards. Tabs 54 are adapted to flex downwardly and outwardly. As used herein, the term "outwardly" refers to movement along an axis, typically the horizontal axis, from an inner originating point within conduit section 26 to an outer terminating point that is further from the center of conduit section 26 then the originating point. As divergent diffuser section 14 is urged (during assembly) within convergent base section 12, annular flange 52 is pressed against tabs 54, which tabs 54 flex downwardly and outwardly to permit passage of flange 52, and return to a more inward position after annular flange 52 has passed, thereby inter-locking divergent diffuser section 14 to convergent base section 12. In one embodiment, annular flange 52 is disposed at a height approximately 1.6 inches from entry area 28 and approximately 2.5 inches from exit area 30 and extends radially approximately 0.25 inches from outer surface 53 of divergent diffuser section 14.

Collapsible water tower 18 comprises a base tower section 56, a middle tower section 58 and a top tower section 60. Collapsible water tower 18 is adapted so as to be interlockably extendible in one direction while axially collapsible in the opposite direction. Collapsible water tower 18 is sized such that base tower section 56, when in an axially extended position interlocks with hub area 32, middle tower section 58 interlocks with base tower section 56, and top tower section 60 interlocks with middle tower section 58 such that during washing or rinsing phases of operation, water tower 18 is reactively extended in a telescoping manner by pressure of the fluid supplied by the pump, to facilitate relatively broad washing or rinsing coverage, while during a drying phase or during down times, water tower 18 is adapted to be nestably positioned, within conical inner chamber area 48. As used herein, "nestably positioned" refers to the capability of a telescoping device comprising multiple sectioned components to collapse within larger diameter components so as to allow the collapsed components to fit into a compact area. Water tower 18 typically comprises a polymer such as 20% Talc-filled Polypropylene. In one embodiment, base tower section 56 is generally cylindrical in shape and has a height of approximately 2.0 inches and a diameter of approximately 1.6 inches, middle tower section is generally cylindrical in shape and has a height of approximately 2.9 inches and a diameter of approximately 1.25 inches, and top tower section 60 is generally cylindrical in shape and has a height of approximately 3.9 inches and a diameter of approximately 0.9 inches.

In accordance with one aspect of the instant invention, a longitudinal drainage groove 62 (FIG. 1) is disposed along an inner wall 64 of divergent diffuser section 14. Drainage groove 62 originates at a point proximate exit area 30 and extends longitudinally along inner wall 64 and terminates at a point proximate entry area 28. Drainage groove 62 facilitates the removal of excess water that remains in each wing section 34, 36 when a washing or rinsing cycle is completed and spray-arm 16 stops rotating. Additionally, because collapsible water tower 18 is nestably positioned within conical inner chamber area 48, water drainage about nested water tower 48 is restricted as the outermost surface of water tower 18 is typically closely fitting to inner wall 64 of divergent diffuser section 14, i.e., the outside diameter of water tower 18 is substantially similar to the inside diameter of inner chamber area 48. Accordingly, drainage groove 62 serves an additional purpose, in that it provides a means for fluid to drain around collapsible water tower 18. While a single drainage groove 62 is depicted in the drawings, the present invention may include one or more additional drainage grooves 62 spaced about inner wall 64. In one embodiment, drainage groove 62 extends approximately 3 inches from a point proximate exit area 30 to a point that is located below the lowermost extent of collapsible water tower 18 when collapsible water tower 18 is nestably positioned within conical inner chamber area 48.

Figure 3:
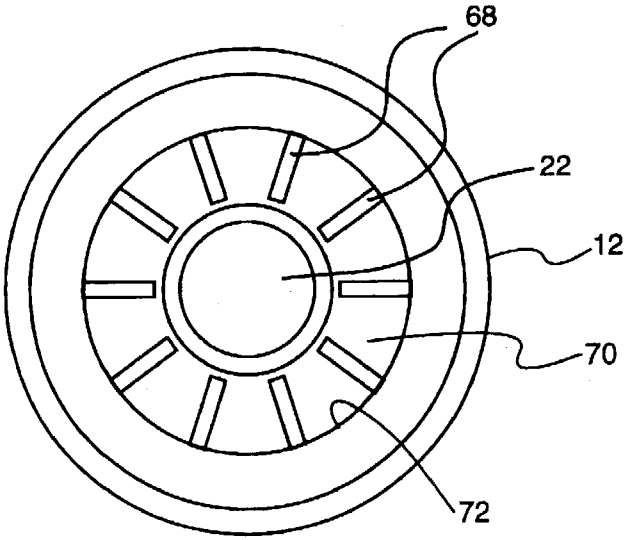
FIG. 3 is a top plan view of convergent base section of the instant invention.
Figure 4:
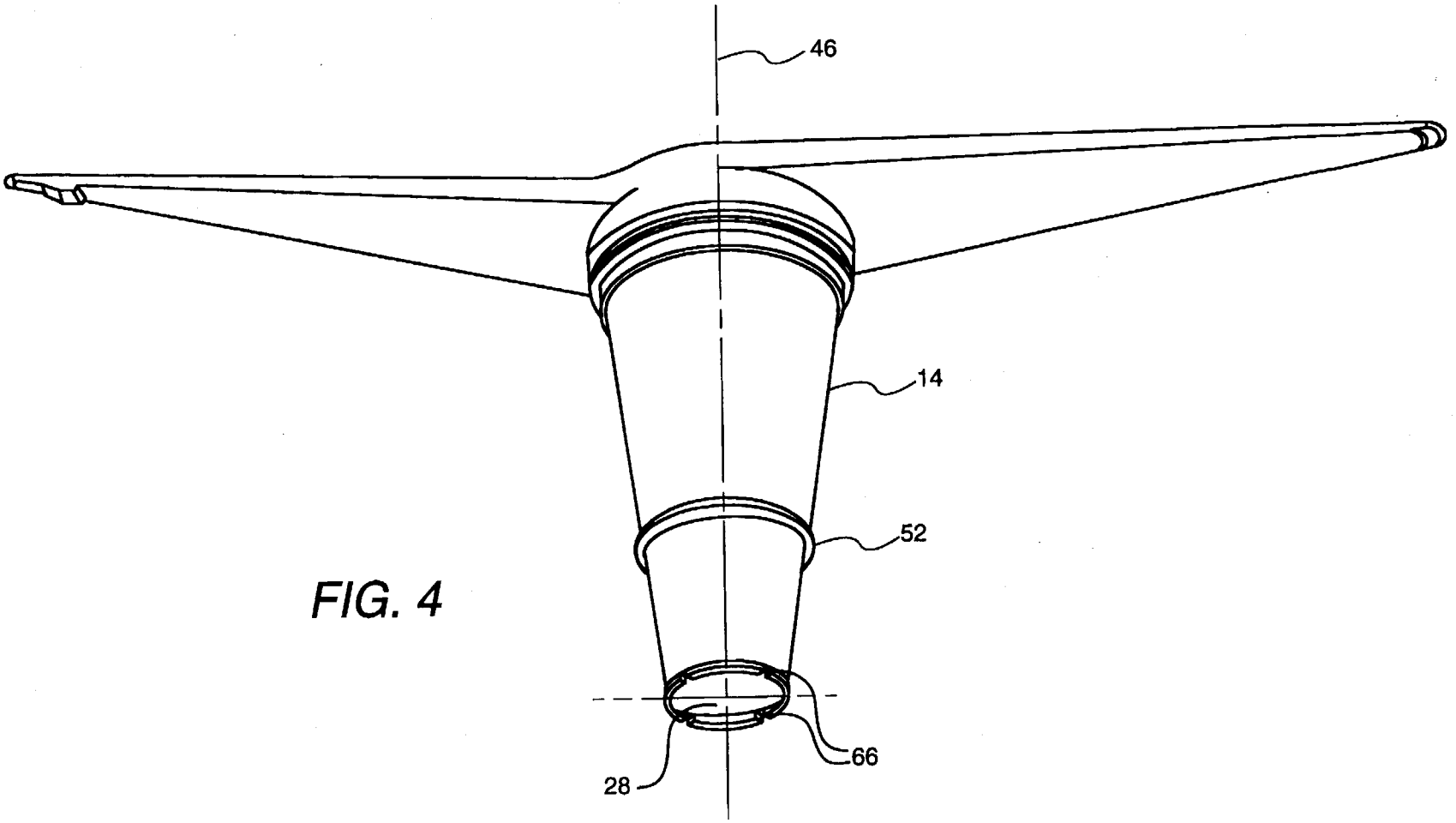
FIG. 4 is a perspective view of the divergent diffuser section 14 in accordance with the instant invention.

In accordance with another aspect of the instant invention, a plurality of drainage notches 66 are disposed in divergent diffuser section 14 about the periphery of entry area 28 to provide drainage passages between divergent diffuser section 14 and convergent base section 16, as illustrated in FIG. 3. Drainage notches 66 are particularly useful to drain water which remains in collapsible water tower 18 after the washing or rinsing phase is completed. In one embodiment, four drainage notches 66 are equally spaced about the periphery of entry area 28. In one embodiment, each respective drainage notch 66 comprises an inverted u-shaped cutout with an outside width of approximately 0.14 inches and a center height of approximately 0.125 inches.

In accordance with another aspect of the instant invention, a plurality of ribs 68, illustrated in FIGS. 1 & 3, are disposed on an inner bottom surface 70 of lower cylindrical conduit section 24 so as to provide a temporary storage area for food particles that flow to this location during drainage and to hold divergent diffuser section 14 in alignment with convergent base section 12 while allowing drainage water to exit spray arm assembly 10. Ribs 68 are typically, although not necessarily, evenly spaced about inner bottom surface 70. In one embodiment, ribs 68 extend from an inner wall 72 of lower cylindrical conduit section 24 to a point bordering throat section 22, sloping downwardly toward inner bottom surface 70. As used herein, the term "downwardly" refers to descending along an axis, typically the vertical axis, from a higher originating point to a lower terminating point. In one embodiment, ten ribs 68 are equally spaced about the inner bottom surface 68 of lower cylindrical conduit section 24.

During a washing or rinsing phase of operation of the illustrative embodiment herein described, washing or rinsing fluid is pumped into bell mouth 20 (FIG. 1), and travels through throat 22 into entry area 28 of divergent diffuser section 14. Because of the venturi nature of convergent base section 12 and divergent diffuser section 14, as discussed above, the pressure inside of spray-arm assembly 10 at throat 22 is equal or nearly equal to the external pressure. Accordingly, little or no water leaks from spray-arm assembly 10, improving performance capabilities and lowering the likelihood of part deterioration. As the fluid is pumped through the divergent diffuser section, the fluid pressure forces water tower 18 upwards so as to extend the coverage and washing abilities of the assembly. The water is forced into wing sections 34, 36 and exits through directionalized orifices 44, thereby reactively driving the spray arm in a direction opposite the orifice orientation in a horizontal plane.

Upon completion of the washing or rinsing phase, the water or rinsing fluid is drained from spray-arm 16. The fluid which is in the outermost sections of wing sections 34, 36 of the spray-arm drains to entry area 28 of divergent diffuser section 14 via drainage groove 62, through drainage notches 66 to ribs 68 which protrude from the inner bottom surface 70 of lower cylindrical conduit section 24. If any food particles have been carried within the draining fluid to the ribs 68, they will be captured by the spaced apart ribs 68 and temporarily stored until flush-out occurs, so as to prevent binding or interference with spray arm rotation.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A dishwasher spray-arm assembly for distributing cleaning fluid comprising:

a convergent base section having a bell mouth, a throat section, and a cylindrical housing extending axially along the periphery of said throat section;

a rotatable spray-arm having an open hub area and at least two hollow wing sections radially extending from said open hub area;

a divergent diffuser section having an entry area and an exit area, said divergent diffuser section integral with said spray-arm and positioned such that said entry area is aligned with said throat section of said convergent base section;

a collapsible water tower adapted to be nestably positioned within said conical chamber area in a collapsed position; and said spray-arm being integrally coupled with said divergent diffuser section such that said open hub area is aligned with said exit area of said diffuser section so as to define a conical chamber area.

2. A dishwasher spray-arm assembly in accordance with claim 1, further comprising a longitudinal drainage groove disposed within an inner wall of said divergent diffuser section wherein said drainage groove originates proximate said exit area and terminates proximate said entry area.

3. A dishwasher spray-arm assembly in accordance with claim 2, wherein said longitudinal drainage groove originates proximate said exit area, extends longitudinally about 3 inches and terminates proximate said entry area at a point located below the lowermost extent of said collapsible water tower when in a collapsed position.

4. A dishwasher spray-arm assembly in accordance with claim 1, further comprising at least one drainage notch formed in a sidewall of said diffuser section at said entry area so as to provide a drainage passage between said diffuser section and said convergent base section.

5. A dishwasher spray-arm assembly in accordance with claim 4, wherein said drainage notch has a cross-sectional shape of an inverted u-shaped cutout having an outside width of approximately 0.14 inches and a center height of approximately 0.125 inches.

6. A dishwasher spray-arm assembly in accordance with claim 4, wherein said at least one drainage notch comprises four drainage notches equally spaced about the periphery of said entry area.

7. A dishwasher spray-arm assembly in accordance with claim 1, further comprising a plurality of ribs disposed on an inner bottom surface of convergent base section so as to provide a temporary collection location for food particles that flow to this location during drainage.

8. A dishwasher spray-arm assembly in accordance with claim 7, wherein said ribs are evenly spaced about said inner bottom surface bordering said throat.

9. A dishwasher spray-arm assembly in accordance with claim 7, wherein said plurality of ribs comprise ten ribs equally spaced about said inner bottom surface bordering said throat.

10. A dishwasher spray-arm assembly comprising:

a convergent base section having a bell mouth, a throat section, and a cylindrical housing extending axially along the periphery of said throat section;

a divergent diffuser section having an entry area and an exit area, said divergent diffuser section integral with said spray-arm and positioned such that said entry area is aligned with said throat section of said convergent base section;

a rotatable spray-arm having an open hub area and at least two hollow wing sections radially extending from said open hub area, said spray-arm integral with said divergent diffuser section such that said open hub area is aligned with said exit area of said diffuser section so as to define a conical chamber area;

a collapsible water tower adapted to be nestably positioned within said conical chamber area; and a longitudinal drainage groove disposed within an inner wall of said divergent diffuser section wherein said drainage groove originates proximate said exit area and terminates proximate said entry area.

11. A dishwasher spray-arm assembly in accordance with claim 10, further comprising at least one drainage notch formed in said sidewall of said diffuser section at said entry area so as to create a drainage passage between said diffuser section and said convergent base section.

12. A dishwasher spray-arm assembly in accordance with claim 10, further comprising a plurality of ribs disposed on an inner bottom surface of convergent base section so as to provide a temporary collection location for food particles that flow to this location during drainage.

13. A dishwasher comprising:

a convergent base section having a bell mouth, a throat section, and a cylindrical housing extending axially along the periphery of said throat section;

a divergent diffuser section having an entry area and an exit area, said divergent diffuser section integral with said spray-arm and positioned such that said entry area is aligned with said throat section of said convergent base section;

a rotatable spray-arm having an open hub area and at least two hollow wing sections radially extending from said open hub area, said spray-arm integral with said divergent diffuser section such that said open hub area is aligned with said exit area of said diffuser section so as to define a conical chamber area;

a collapsible water tower adapted to be nestably positioned within said conical chamber area; and at least one drainage notch disposed in said sidewall of said diffuser section at said entry area so as to create a drainage passage between said diffuser section and said convergent base section.

14. A dishwasher spray-arm assembly in accordance with claim 13, further comprising a plurality of ribs disposed on an inner bottom surface of convergent base section so as to provide a temporary collection location for food particles that flow to this location during drainage.

* * * * *